United States Patent [19]

Sugisawa et al.

[11] Patent Number: 4,874,580

[45] Date of Patent: Oct. 17, 1989

[54] PRESSURE-CONTROLLING METHOD

[75] Inventors: Ko Sugisawa; Yasushi Matsumura, both of Nara; Hidefumi Okamoto, Sakai; Hiroshi Hayami, Nara, all of Japan

[73] Assignee: House Food Industrial Company Limited, Japan

[21] Appl. No.: 97,401

[22] Filed: Sep. 14, 1987

Related U.S. Application Data

[63] Continuation of Ser. No. 743,952, Jun. 12, 1985, abandoned.

[30] Foreign Application Priority Data

Jun. 12, 1984 [JP] Japan ..... 59-121066

[51] Int. Cl.[4] ..... A23L 3/12; A61L 2/06

[52] U.S. Cl. ..... 422/25; 422/26; 422/112; 426/113; 426/232; 426/401; 426/407

[58] Field of Search ..... 422/25, 26, 112; 426/113, 232, 401, 407

[56] References Cited

U.S. PATENT DOCUMENTS

| | | | |
|---|---|---|---|
| 2,868,616 | 1/1959 | Poitras | 422/26 X |
| 3,093,449 | 6/1963 | Kotarski et al. | 422/25 X |
| 3,215,538 | 11/1965 | Sada | 422/25 X |
| 3,531,300 | 9/1970 | Greenberg et al. | 426/412 X |
| 4,003,302 | 1/1977 | Mencacci et al. | 426/232 X |
| 4,537,789 | 8/1985 | Sugisawa et al. | 426/407 X |
| 4,657,540 | 4/1987 | Iwamoto et al. | 422/25 X |
| 4,685,507 | 8/1987 | Schäfer | 422/26 X |

FOREIGN PATENT DOCUMENTS

| | | | |
|---|---|---|---|
| 59-66865 | 4/1984 | Japan | 426/232 |
| 671800 | 7/1979 | U.S.S.R. | 422/25 |

*Primary Examiner*—Barry S. Richman
*Assistant Examiner*—Jill Johnston
*Attorney, Agent, or Firm*—Harry M. Weiss & Assoc.

[57] ABSTRACT

Air-containing packages are subjected to heat sterilizing under pressure in a sterilization treatment tank. A pressure controlling method comprises changing the rate-of-rise of the temperature in the treatment tank in the vicinity of a point-of-change in a pressure rise in a pressure pattern in the package and delaying the timing of lowering the pressure in the treatment tank after the start of cooling treatment to avoid any deformation of the packages.

1 Claim, 5 Drawing Sheets

PRESSURE-CONTROLLING METHOD

This is a continuation of co-pending application Ser. No. 743,952 filed on June 12, 1985 now abandoned.

BACKGROUND OF THE INVENTION:

1. Field of the Invention

The present invention relates to a pressure controlling method; at the time of heat sterilizing under pressure, a package formed from a flexible material including plastics, paper, aluminum foil and the like, and more particularly to one which is useful for application to an air-containing package in which a void exists between the package and its contents, or, among others, to a package with a relatively high proportion of air present therein (void volume).

2. Prior Art

Conventionally, at the time of subjecting foodstuffs and the like contained in a flexible package, such as a retort pouch, to heat sterilizing treatment under pressure in a sterilization treatment tank and the like, various pressure-controlling operations are effected from the viewpoint of preventing the breakage or deformation of packages which would result from pressure differential between the pressure in the treatment tank and that in the package.

For instance, a so-called high pressure-type sterilizing method is known wherein the pressure in the treatment tank is increased rapidly from the beginning of the sterilization treatment, constant increased pressure is maintained during a predetermined sterilizing time, and the pressure is decreased rapidly after cooling treatment (refer to the line C in FIG. 1). If this method is used for sterilizing an air-containing package, however, the pressure differential between the pressure in the treatment tank and that in the package at the time of temperature rise becomes extremely large, with the result that deformation and breakage would occur in the case of an ordinary thin-walled package.

In addition, a so-called constant pressure differential-type sterilizing method is also known whereby pressure is controlled while applying a constant pressure differential to saturated steam pressure in response to the temperature in the sterilization treatment tank (refer to the line D in FIG. 1). Even in this method, however, if the air-containing volume of a package which is subjected to sterilization treatment is high (such as when the proportion exceeds 20%), there is a delay before the change in the pressure in the package occurs following the change in the pressure in the treatment tank. Consequently, this results in the deformation of the package at the time of a temperature rise.

Furthermore, according to the aforementioned method, the timing of lowering the pressure in the treatment tank is set at the time of lowering the temperature in the treatment tank (the start of cooling). Accordingly, at the time when the interior of the treatment tank is cooled, the pressure in the package undesirably exceeds that in the treatment tank, resulting in the breakage of the package. Thus, it can be said that this method is not suitable to sterilization of a package with a high proportion of air present therein.

As another conventional method, a so-called dummy method is known wherein a small pot with a peep window is provided separately apart from the sterilization treatment tank, and the pressure in the tank is controlled on the basis of the state of deformation of a model package in the small pot.

According to the aforementioned method, however, it is necessary to provide the small pot, and a dummy package must be used every time sterilization is carried out, which is troublesome in terms of operation. Moreover, expert skill is required for visually discerning the state of deformation of the dummy package which serves as the basis of pressure control. Hence, it is extremely difficult to effect pressure control as desired.

SUMMARY OF THE INVENTION

Accordingly, the present invention provides a method of effecting sterilization treatment effectively without causing damage to or deformation of a package by effecting accurate control of pressure in a treatment tank even in a case where a container with a high proportion of contained air is subjected to sterilization.

The present inventors measured changes in the pressure in packages at the time of effecting heat sterilization under pressure using a multiplicity of package samples with a high proportion of contained air which were filled with various contents and which are constituted by various packaging materials. As a result, it was found that the pressure rise is extremely slow in each case, and, at the same time, there is a change in pressure rise until the pressure in the package reaches its peak, irrespective of differences in the volume of contained air, type of contents, or the type and thickness of the packaging materials.

The inventors also found that, with respect to the pattern of decline in the pressure in the package from the beginning of a drop in the temperature in the treatment tank, i.e., from the start of cooling treatment, the speed at which the pressure in the package lowers is appreciably delayed, and that a large pressure differential is hence liable to occur between the pressure in the package and that in the treatment tank. Furthermore, the inventors conducted intensive research in an attempt to make it possible for the pattern of change in the pressure in the tank to follow as practically as possible the change in the pressure in the package with a high rate of air contained. As a result, the inventors completed the present invention after finding that it is possible to effect desired sterilization treatment by making a substantially constant and appropriate large pressure differential between the pressure in the treatment tank and that in the package not to cause breakage to or deformation of the package as in the case of a conventional pressure controlling method. This is effected by changing the rate-of-rise of the pressure in the treatment tank in the vicinity of a point where the pressure rise in the package changes, and by delaying the timing of lowering the pressure in the tank after the start of cooling treatment.

BRIEF DESCRIPTION OF THE DRAWINGS

Further description of the present invention will be made below with reference to the accompanying drawings.

In FIG. 1, the line 'A' indicates temperature pattern in the treatment tank, while the line 'B' indicates the pressure pattern in the air-containing package.

Incidentally, an air-containing package with an air-containing rate of 50% was used with respect to the line 'B'.

Figure 1:
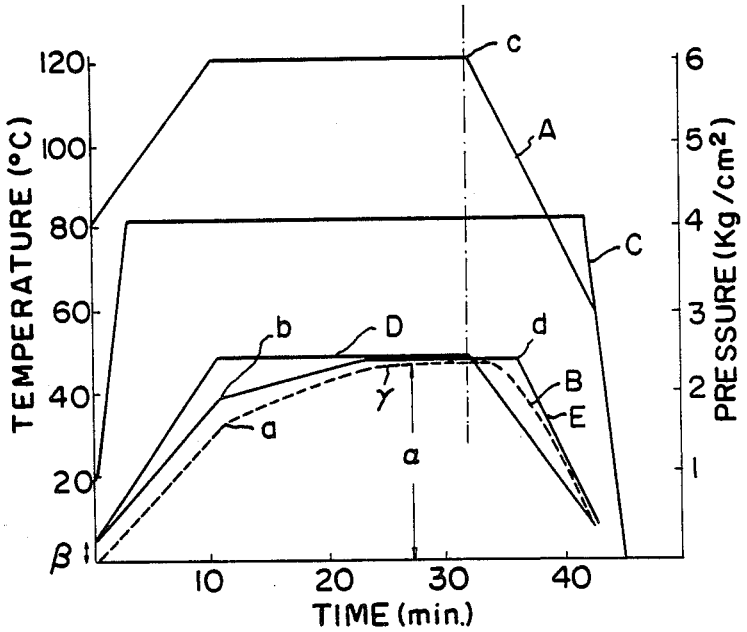
FIG. 1 is a graph illustrating the relationships between pressure and temperature on the one hand, and time on the other for comparing the method of the present invention with a conventional method.

Furthermore, the lines 'C' and 'D' in FIG. 1 indicate the pressure patterns in the treatment tank relating to conventional pressure-controlling methods described earlier, wherein the line 'C' indicates that obtained by the high pressure-type sterilizing method, and 'D' that by the contant pressure-type sterilizing method.

As is apparent from FIG. 1, in the case of the high pressure-high sterilizing method, the pressure differential between the pressure in the treatment tank and that in the package becomes extremely large particularly at the time of a temperature rise, as mentioned with reference to the prior art. Also, in the case of the constant pressure-type sterilizing method, the temperature difference at the time of a temperature rise was large, while the pressure in the package undesirably exceeded that in the treatment tank. In both cases, deformation of and damage to the container occurred.

In contrast, the line 'E' in the figure indicates the pressure pattern in the treatment tank relating to the pressure-controlling method according to the present invention. The line 'E' is characterized in that at the point 'b', namely, virtually at the same point in time as the point of change 'a' in the phase of increase in the pressure in the package, the rate-of-rise of the pressure changes to a lower level, and that the timing of lowering the pressure in the tank is delayed after the point 'c', namely, the start of cooling treatment. As a result, an appropriate pressure difference is maintained in relation to the pressure in the package throughout the sterilization treatment.

In implementing the pressure-controlling method according to the present invention, the pattern of change under specific conditions of sterilizing temperature in the pressure in the air-containing package in which the contents to be sterilized have already been packed is first detected.

As for this detecting method, the following method can be cited: After a thermocouple is installed inside the package in such a manner as to be capable of measuring the temperature of the contents and that of the void portion, this package is placed in the sterilization treatment tank. Then, sterilization treatment is effected under specific conditions of sterilization temperature, and measurement is made of the patterns of change in the temperature of the contents and that of the void portion. On the basis of the results of this measurement, a pattern of change in the pressure in the package is obtained.

Specifically, an approximate expression of the pressure in the package is obtained by the following formula:

$$\text{Internal pressure } (\text{kg/cm}^2) = \text{Atmospheric pressure } (\text{kg/cm}^2 \cdot \text{abs}) \times \frac{\text{Temperature of the void portion at a fixed time (°K.)}}{\text{Initial temperature of the void (°K.)}} +$$

-continued $$\text{Saturated steam pressure corresponding to the temperature of contents in a fixed time } (\text{kg/cm}^2 \cdot \text{abs}) - \text{Atmospheric pressure } (\text{kg/cm}^2 \cdot \text{abs})$$

In the above formula, however, the pressure in the package prior to sterilization treatment is calculated as the atmospheric pressure. Additionally, the initial temperature of the void portion is regarded as being substantially identical with the initial temperature of the contents.

Incidentally, at the time of effecting the aforementioned sterilization treatment, it is desirable particularly in the case of a flexible package to prevent the deformation of the package by adjusting the pressure in the treatment tank so as to minimize measurement errors resulting from a change in the volume of the package due to the change in its internal pressure.

Furthermore, it is also possible to adopt a method of detecting a pressure pattern in the package by directly measuring its internal pressure.

In the present invention, point of change (refer to 'a' in FIG. 1) at the time of a pressure rise in the pressure pattern in the package is found from said pattern obtained by the aforementioned method, and, at the same time, the peak of the presure in the package (refer to '$\alpha$' in FIG. 1) is also detected. In this connection, the predetermined pressure differential (refer to '$\beta$' in FIG. 1) at the start of sterilization and the predetermined pressure differential (refer to '$\gamma$' in FIG. 1) at the peak pressure peak are taken into consideration. The rate-of-rise of the pressure in the treatment tank is calculated such that said rate-of-rise of the pressure will change in the vicinity of the aforementioned point of change (the form of change in the pressure in the treatment tank should be preferably made such as to follow the form of change in the pressure in the package from the viewpoint of securing an appropriate pressure difference; accordingly, in this case, said rate-of-rise of the pressure is caused to change to a lower level), and the control at the time of increasing the pressure in the treatment tank is thus effected.

Furthermore, the pressure-controlling method of this invention includes effecting a control of the timing of lowering the pressure in the treatment tank in such a manner that the start of a drop in said pressure (refer to 'd' in FIG. 1) is delayed after the start of cooling treatment (refer to 'c' in FIG. 1).

Incidentally, with respect to the pressure difference at the start of sterilization treatment or set conditions of a pressure difference during a peak of the pressure in the package, no particular restrictions are imposed insofar as the pressure difference does not become negative, i.e., insofar as the pressure in the package does not exceed that in the treatment tank. Particularly in cases where the heating medium is steam, it is desirable to set the pressure difference within the range of 0.0 to 1.0 $\text{kg/cm}^2$ in order to prevent the deformation of the package and also to prevent a drop in thermal efficiency.

In addition, the point of change in the rate-of-rise of the pressure in the treatment tank is preferably set within the range of 30 to 50% of the time for reaching the point of change (i.e., the time required from the start of sterilization until the point of change) on the basis the point of change in the rate-of-rise of the pressure in the package as a standard. This setting is preferable since it makes it possible to make constant and maintain an appropriate pressure difference at the time of the pressure rise in the package.

Moreover, in setting the starting time of a drop in the pressure in the treatment tank, it is preferable to take into consideration the speed of a drop in the pressure in the package, or lowering the temperature in the treatment tank. To cite an example, in the case of a normal cooling method (a gradually cooling method whereby cooling water is fed into the treatment tank and hot water in the treatment tank is discharged through a discharge pipe), it is preferable to start to allow the pressure in the treatment tank to lower within the range of 30% to 50% of the time required in cooling treatment from the start of cooling after completion of sterilization treatment.

DESCRIPTION OF PREFERRED EMBODIMENT

Figure 4:
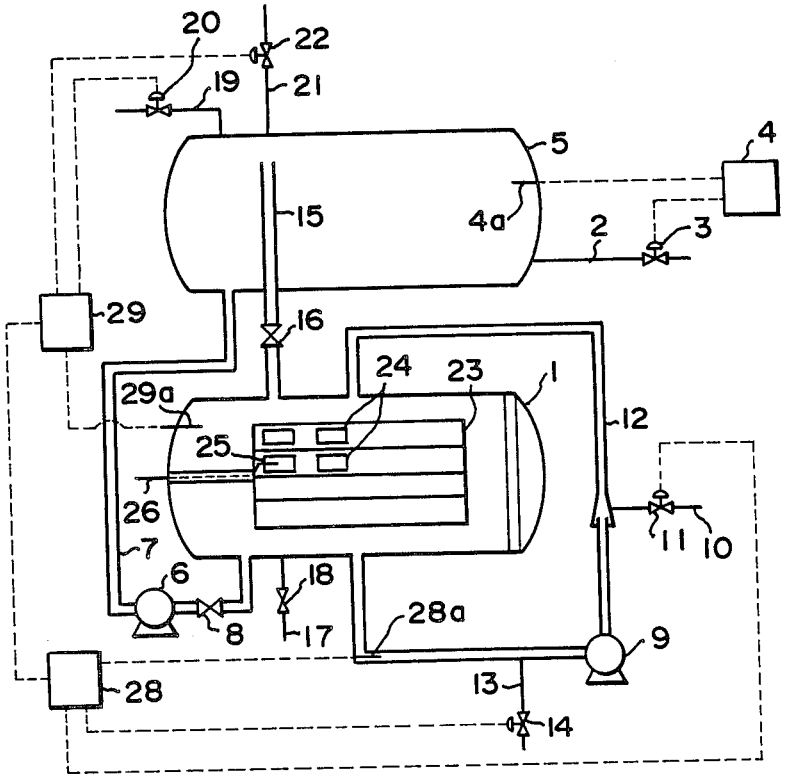
FIG. 4 is a schematic view of a treatment apparatus for carrying out the method of the invention.
Figure 5:
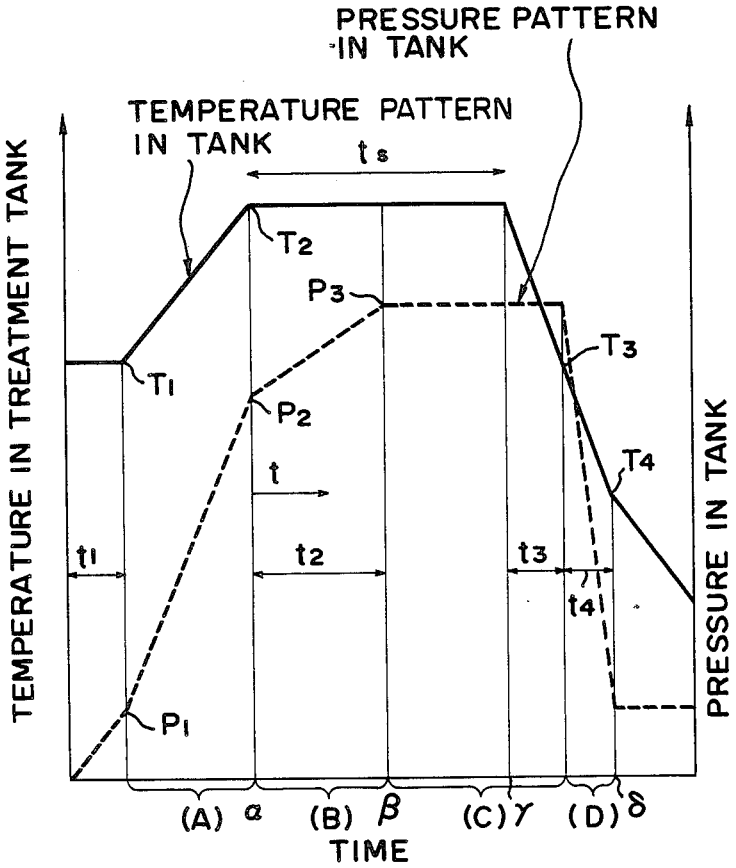
FIG. 5 is a graph showing the temperature and pressure patterns in the tank.

Referring to FIG. 4, specific description will be made of an example of the operating procedure of the method of heat sterilization under pressure in accordance with the present invention. After air-containing packages 24 with their contents packed therein has been placed in a retort body 1, and after hermetically sealing the retort, a valve 3 is opened to introduce steam through pipe 2 into a storage tank 5, thereby heating hot water therein with the steam. A temperature control device 4 has its sensor 4*a* for detecting the temperature of hot water in the storage tank 5 and functions to close the valve 3 when the hot water has been heated to the temperature of 90° C. Then, a pump 6 is actuated and a shut-off valve 8 is opened to introduce the hot water from the tank 5 through a pipe 7 into the retort body 1. After the air-containing packages 24 on a sterilizing rack 23 is immersed sufficiently in hot water, the shut-off valve 8 is closed and the pump 6 is stopped. Then, a circulation pump 9 is actuated and a valve 11 is opened to supply steam through a steam pipe 10 into a circulating pipe 12, thereby starting heating the hot water in the retort body 1 for sterilization operation.

Upon completion of a sterilizing process at the risen temperature, the steam valve 11 is closed, and a water supply valve 14 is opened to supply cooling water through a water supply pipe 13 and pipe 12 into the retort body. At the same time, a valve 16 is opened so that hot water in the retort body is returned through the pipe 15 to the storage tank 5, thereby cooling the package gradually with the cooling water flowing into the retort body 1.

Upon completion of the cooling process, the water supply valve 14 is closed while at the same time, the valve 16 is also closed. A water discharge valve 18 is opened to discharge the cooling water from the retort body 1 through a water discharge pipe 14, thereby completing the sterilization process.

When effecting control based upon the pressure pattern in the treatment tank obtained by taking into account a predetermined pressure difference, the following example can be specifically given.

During the temperature rise and cooling process, the temperature of the hot water in the retort is detected by means of a sensor 28*a* of a temperature control unit 28 during recirculation of the hot water through the pipe 12, and a signal is given to a pressure control unit 29. A pressure controlling signal is obtained on the basis of the temperature signal from calculating formula given by a program stored in advance and the function of a built-in timer. The pressure controlling signal and a signal obtained by detecting the pressure in the retort by a sensor 29*a* of the pressure controlling apparatus 29 are arithmetically processed so as to give on or off signal to a pressurizing valve 22 and a vent valve 20, thereby controlling the pressure in the retort.

Specifically, the program used in the computer is as follows.

(A) The control value $P_c$ of the pressure in the treatment tank during the process of the temperature rise can be obtained by the following formula:

$$P_c = \frac{P_2 - P_1}{T_2 - T_1} \times (T_M - T_1) + P_1$$

where $T_1$ is the temperature of the hot water at a point of time $t_1$ from the start of supply of hot water into the sterilization treatment tank until the beginning of heating after the air-containing package on the sterilizing rack has been sufficiently immersed in the hot water; $P_1$ is the initial pressure setting; $T_2$ is the sterilizing temperature; $P_2$ is a pressure setting at a point where the sterilizing temperature is reached; and $T_M$ is the temperature in the tank. Then, the control value $P_c$ is arithmetically compared with pressure $P_M$ detected by the sensor 29*a*. to control the tank pressure through the pressure controlling unit 29.

(B) The control value $P_c$ of the pressure in the treatment tank during the sterilizing process can be obtained by the following formula:

$$P_c = \frac{P_3 - P_2}{t_2} \times t + P_2$$

where the point $\gamma$ of reaching the sterilizing temperature is assumed to be the point of change in the pressure in the package; $t_2$ is the time from the point of reaching the sterilizing temperature up to a peak point $\beta$ in the pressure in the package; $P_3$ is a maximum pressure setting at that point of time $\beta$; and t is the elapse of time from the point $\alpha$ of reaching the sterilizing temperature. The control value $P_c$ is arithmetically compared with pressure $P_M$ detected by the sensor 29*a* to a control the tank pressure through the pressure controlling unit 29.

(C) The maximum pressure setting $P_3$ is maintained during the sterilizing process following the peak point $\beta$ of the pressure in the package.

The pressure in the treatment tank is retained at the maximum pressure setting $P_3$ until the time $t_3$ after the cooling water is supplied to start the cooling process following the sterilizing process.

(D) Furthermore, the control value $P_c$ of the pressure in the treatment tank during the cooling process can be obtained by the following formula:

$$P_c = P_3 - \frac{P_3 - P_4}{T_3 - T_4} \times (T_3 - T_M)$$

where $T_3$ is the temperature of the hot water in the treatment tank after elapse of the time $t_3$ following the start $\gamma$ of the cooling process; $T_4$ is the temperature of the hot water in the treatment tank after elapse of the time ($t_3+t_4=\gamma$) following the start $\gamma$ of the cooling process; $P_4$ is a pressure setting at that juncture; and $T_M$ is the detected temperature of the hot water in the treatment tank. This value $P_c$ is arithmetically compared with the pressure $P_M$ detected by the sensor 29*a* to control the tank pressure through the pressure controlling unit 29.

In the present invention, heat sterilization under pressure is effected by carrying out pressure control as described above.

EXAMPLE 1

After putting 100 g potato in 25 mm squares and 75 g water in a polypropylene package (300 cc), the package was hermetically sealed with a polypropylene- and polyester-laminated film (air-containing volume: 50%) and was subsequently placed in a sterilization treatment tank. Incidentally, a thermocouple was provided in the package so as to measure the temperature of the contents and that of the void portion.

Figure 2:
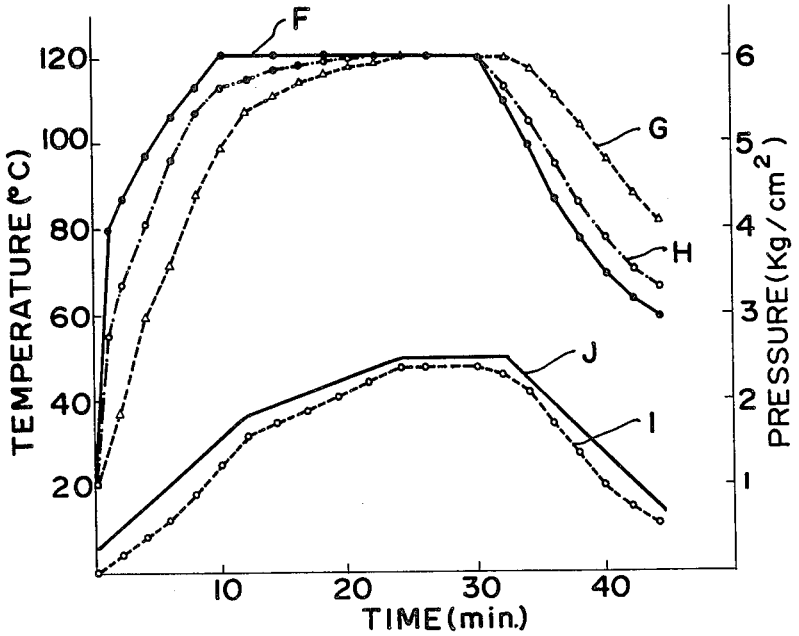
FIGS. 2 and 3 are graphs illustrating pressure change in accordance with the examples of the present invention.

Next, after hermetically sealing the treatment tank, the inside of the treatment tank was subjected to initial pressurization (0.25 kg/cm$^2$), and 90° C. hot water was fed from a hot water storage tank into the treatment tank. Subsequently, the temperature of the treatment tank was caused to rise as shown by the line F in FIG. 2, and sterilization treatment was carried out for 20 minutes after the temperature reached 121° C. (in the meantime, the pressure in the treatment tank was adjusted by means of valves in such a way as to preclude the deformation of the package). Then, measurement was made to obtain the pattern of the temperature of the contents (refer to the line G in FIG. 2) and the pattern of temperature in the void portion (refer to the line H in FIG. 2).

From these measurements of the patterns of temperature, it was possible to calculate the pressure in the package according to the aforementioned calculating formula. This pattern of pressure in the package is shown by the line I in FIG. 2.

On the basis of this pattern, the point of change in the pressure in the treatment tank was set to 12 minutes after the start of sterilization treatment, and the pressure at that time was set at 1.8 kg/cm$^2$ (the pressure difference being "the pressure in the package+0.2 kg/cm$^2$"). Furthermore, the starting point of applying constant pressure was set to be 24 minutes after the start of sterilization treatment, and the pressure at that time was set at 2.50 kg cm$^2$ (the pressure difference being "the pressure in the package+0.1 kg/cm$^2$). Then, said constant pressure was set such as to be maintained for 32 minutes after the start of sterilization treatment (for two minutes after the start of cooling treatment). At the same time, the pressure after a lapse of 14 minutes from the start of cooling treatment was set at 0.70 kg/cm$^2$ (the pressure difference being "the pressure in the package+0.1 kg/cm$^2$").

The rate-of-rise and drop of the pressure in the container were calculated on the basis of the aforementioned set conditions, namely: the rate-of-rise, 0.13 kg/cm$^2$/min (0 to 12 minutes after the start of sterilization treatment) to 0.06 kg/cm$^2$/min (12 to 24 minutes after the start of sterilization treatment); and the rate-of-drop, 0.15 kg/cm$^2$/min (32 to 44 minutes after the start of sterilization treatment). Heat sterilization under pressure was effected using these conditions as a basis of the pressure control setting at the time of effecting sterilization treatment.

Incidentally, the pattern of pressure in the treatment tank obtained by the aforementioned pressure-controlling method is shown by the line J in the figure.

As a result of subjecting the above-described packaged foodstuffs to sterilizing treatment under the aforementioned conditions in a 20-bag treating tank, no deformation of or damage to the packages was observed.

EXAMPLE 2

After 30 g potato in 15 mm squares, 15 g carrot in 10 mm squares, and 135 g curry sauce had been put in a polypropylene package (300 cc), the package was hermetically sealed with a polypropylene- and polyester-laminated film (air-containing volume: 40%) and was subsequently placed in a rotary-type sterilization treatment tank. Incidentally, a thermocouple was provided in the package so as to measure the temperature of the contents.

Next, after hermetically sealing the treatment tank, the inside of the treatment tank was subjected to initial pressurization (0.25 kg/cm$^2$), and 90° C. hot water was fed from a hot water storage tank into the treatment tank while rotating a tray with the package placed on it at a speed of 2 rpm.

Subsequently, the temperature of the inside of the treatment tank was caused to rise as shown by the line K in FIG. 3, and sterilization treatment was carried out for 20 minutes after the temperature reached 121° C. (in the meantime, the pressure in the treatment tank was adjusted by means of valves in such a way as to preclude deformation of the package). Then, measurement was made to obtain the pattern of temperature of the contents as shown by the line L in FIG. 3.

From the measurement results of the pattern of temperature, it was possible to calculate the pressure in the package according to the aforementioned calculating formula. This pattern of pressure in the package is shown by the line M in FIG. 3. Incidentally, in the calculation, the temperature of the contents was regarded as being identical with that of the void portion.

On the basis of this pattern, the point of change in the pressure in the treatment tank was set at 14 minutes after the start of sterilization treatment, and the pressure at that time was set at 2.25 kg/cm$^2$(the pressure difference being "the internal pressure of the package+0.3 kg/cm$^2$").

Furthermore, the starting point of applying constant pressure was set to be 30 minutes after the start of sterilization treatment, and the pressure at that time was set at 2.75 kg/cm$^2$ (the pressure difference being "the pressure in the package+0.2 kg/cm$^2$"). Then, the constant pressure was set such as to be maintained for 32 minutes after the starting of sterilization treatment (for two minutes after the start of cooling treatment). At the same time, the pressure after a lapse of 12 minutes from the start of cooling treatment was set at 0.95 kg cm$^2$ (the pressure difference being "the pressure in the package+0.1 kg/cm$^2$").

The rates-of-rise and drop of the pressure in the package were calculated on the basis of the aforementioned set conditions, namely: the rate-of-rise, 0.14 kg/cm$^2$/min (0 to 14 minutes after the start of sterilization treatment) to 0.03 kg/cm$^2$/min (14 to 30 minutes after the start of sterilization treatment): and the rate-of-drop, 0.18 kg/cm$^2$/min (32 to 42 minutes after the start of sterilization treatment). Heat sterilization under pressure was effected using these conditions as a basis for the pressure control setting at the time of sterilization treatment.

Figure 3:
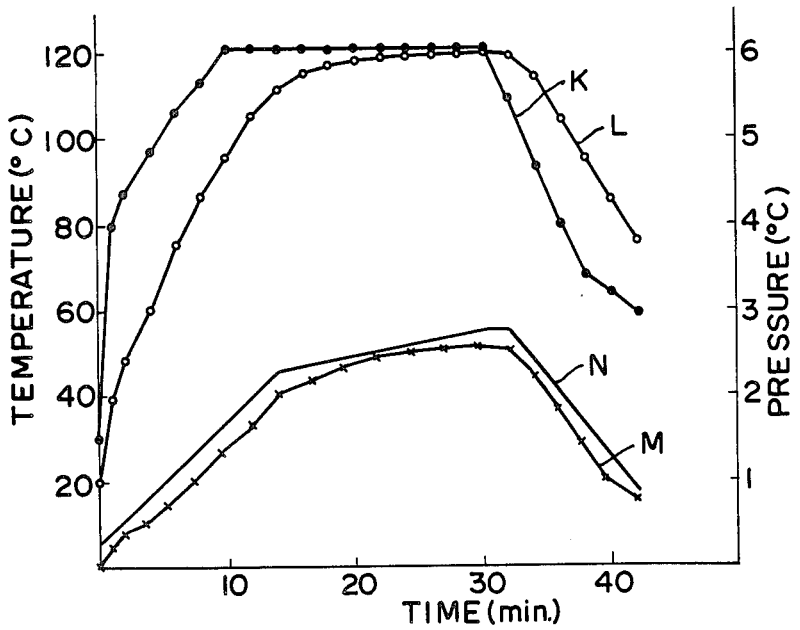

Incidentally, the pattern of pressure in the treatment tank obtained by the aforementioned pressure-controlling method is shown by the line N in FIG. 3.

As a result of subjecting the above-described packaged foodstuffs to sterilizing treatment under the aforementioned conditions in a 20-bag treating tank, no deformation of or damage to the package was observed.

The present invention makes it possible to effectively carry out heat sterilization under pressure of air-containing packages, i.e., packages in which a void exists between the contents contained therein and each of the packages, without causing deformation of or damage to the packages even in cases where the packages are formed from a flexible material such as plastic.

Furthermore, the present invention also makes it possible to eliminate the inconvenience of using a dummy container every time sterilization treatment is carried out, and makes it possible to effect sterilization efficiently with an appropriate pressure difference between the pressure in the package and that in the tank.

What is claimed is:

1. A method for sterilizing a sealed package containing air, comprising the steps of placing the package in a sealable treatment tank, sealing said sealable treatment tank, introducing hot water into said sealable treatment tank at a predetermined temperature, further heating said hot water to another predetermined temperature and maintaining said other predetermined temperature constant for a predetermined time, removing said hot water while introducing hot water for a predetermined cooling period of time within said sealable treatment tank during said steps of introducing hot water, further heating said hot water and maintaining said other predetermined temperature to change the rate-of-change of said pressure to near a point-of-change in a pressure rise in said package and controlling said pressure within said sealable treatment tank during said step of removing said hot water while introducing cool water for said predetermined cooling period of time whereby the lowering of pressure in the treatment tank begins at a period within the range of 30% of the predetermined cooling period of time to maintain the pressure in said sealable treatment tank near a point-of-change of the pressure within said package.

* * * * *

UNITED STATES PATENT AND TRADEMARK OFFICE

CERTIFICATE OF CORRECTION

PATENT NO. : 4,874,580

DATED : Oct. 17, 1989

INVENTOR(S) : Sugisawa, et al

It is certified that error appears in the above-identified patent and that said Letters Patent is hereby corrected as shown below:

On the title page, item [73] should read follows:
Assignee: House Food Industrial Co., Ltd. and
Hisaka Works, Ltd.

Signed and Sealed this

Eleventh Day of August, 1992

*Attest:*

DOUGLAS B. COMER

*Attesting Officer*

*Acting Commissioner of Patents and Trademarks*